US006264057B1

(12) United States Patent
Kim

(10) Patent No.: US 6,264,057 B1
(45) Date of Patent: Jul. 24, 2001

(54) DRINK INSTRUMENT WITH INTERNAL STRAW

(76) Inventor: Byung O Kim, 15364 NW. Dane La., Portland, OR (US) 97229

( * ) Notice: Subject to any disclaimer, the term of this patent is extended or adjusted under 35 U.S.C. 154(b) by 0 days.

(21) Appl. No.: 09/558,446

(22) Filed: Apr. 25, 2000

(51) Int. Cl.[7] ..... A47G 19/22

(52) U.S. Cl. ..... 220/706; 220/709; 220/710; 215/389

(58) Field of Search ..... 220/706, 710, 220/709; 215/388, 389

(56) References Cited

U.S. PATENT DOCUMENTS

| | | | | |
|---|---|---|---|---|
| 5,080,247 | * | 1/1992 | Murphy et al. | 220/706 |
| 5,431,297 | * | 7/1995 | Rosello | 220/706 |
| 5,848,721 | * | 12/1998 | Cornell et al. | 220/706 |
| 5,975,340 | * | 11/1999 | Cornell et al. | 220/706 |
| 6,000,573 | * | 12/1999 | Murphy et al. | 220/706 |
| 6,036,048 | * | 3/2000 | Fischman . | |

* cited by examiner

*Primary Examiner*—Joseph M. Moy

(74) *Attorney, Agent, or Firm*—Lee & Hong

(57) ABSTRACT

A drink instrument in the form of a beverage container has a prepackaged internal straw inserted into the interior thereof during a package process. The internal straw is automatically drawn from the interior of the container when the top is opened to access the drinking fluid therein. The drink instrument with the internal straw includes an internal straw forming a plurality of upright guides which are adapted to be upright at the center portion of the drink instrument, as an integral body with a predetermined outer peripheral surface thereof, the straw comprising an outer pipe and an inner pipe for the purpose of extending the length thereof, being adapted to draw a suction part, and having a predetermined buoyancy; and a straw floating preventing part with a predetermined load being inserted into the lower portion of the straw and being adapted to serve as the bob of weight to be thereby submerged at the lower portion thereof on the bottom of the drink instrument upon the insertion of the straw into the interior of the drink instrument, the straw floating preventing part being made of an edible material which is dissolved in the drinking fluid after a predetermined time elapses, whereby the straw and the straw floating preventing part are inserted into the drink instrument which is to be opened at the center portion of the top surface thereof and upon the opening of the center portion thereof, the straw is drawn to the outside of the drink instrument by the operation of the buoyancy thereof

18 Claims, 13 Drawing Sheets

DRINK INSTRUMENT WITH INTERNAL STRAW

CROSS REFERENCE TO RELATED ART

This application claims the benefit of Korean Patent Application No. 10-2000-0005811, filed on Feb. 8, 2000, which is hereby incorporated by reference.

BACKGROUND OF THE INVENTION

1. Field of the Invention

The present invention relates to a drink instrument, and more particularly, to a drink instrument with an internal straw inserted into the interior thereof during a packaging process, such that it can draw the internal straw automatically from the interior thereof when the drink instrument is opened to address the fluid contained therein.

2. Discussion of Related Art

In general, in case of drinking the drinking fluid within a drink instrument, such as a bottle, a can and the like, a separate straw should be prepared.

This of course gives much inconvenience to those who desire to drink the drinking fluid. To solve the inconvenience, there are provided various kinds of proposals in which a straw is inserted into the interior of the drink instrument such that a user can drink the fluid in a more convenient manner.

In the conventional practice, as shown in FIG. 9, a straw 10 is disposed in the just downward position of an opener 31 of a can 30 and if the opener 31 is depressibly separated from the can 30, the straw 10 is raised upwardly. In the above construction, the straw 10 must be disposed immediately below the opener 31 eccentrically formed on a predetermined position of the can 30, thereby making it difficult to be ideally applied in an automatic process line for, a large scale production of drinking cans.

That is to say, in the package process where the drinking fluid produced on the large scale after passing through a variety of automatic processes is filled in the drink instrument, the additional process in which the straw should be fixedly disposed immediately below the opener eccentrically formed on the predetermined position of the can has to be made by increasing separate facilities therefor and also can not be really realized in some respects, considering the automation production line of the factory.

As shown in FIG. 10, on the other hand, there has been provided another prior art proposal in which the straw 10 is inserted into the interior of a drink bottle 40. As shown, a predetermined hole is formed on a bottle opener 41, through which the straw 10 is inserted. However, this embodiment fails to obtain a practical use.

SUMMARY OF THE INVENTION

Accordingly, the present invention is directed to a drink instrument with an internal straw that substantially obviates one or more of the problems due to limitations and disadvantages of the related arts.

An object of the present invention is to provide a drink instrument with an internal straw in which the straw is positioned to be erected on a center portion of the drink instrument to be automatically drawn upon opening the drink inrurent, by adding a simple process in which the straw is inserted into the interior of the drink instrument regardless of the direction or position of the insertion of straw in an existing factory automation process, such that a production process can be smoothly completed, without having any affect to the package process of the drinking fluid and a mass production can be really achieved, without any difficulties, To accomplish the above and other objects of the present invention, there is provided a drink instrument with an internal straw, including: the straw forming a plurality of upright guides which are adapted to be upright at the center portion of the drink instrument, as an integral body with a predetermined outer peripheral surface thereof, the straw comprised of an outer pipe and an inner pipe for the purpose of extending the length thereof, being adapted to draw a suction part, and having a predetermined buoyancy; and a straw floating preventing part with a predetermined load being inserted into the lower portion of the straw and being adapted to serve as the bob of weight to be thereby submerged at the lower portion thereof on the bottom of the drink instrument upon the insertion of the straw into the interior of the drink instrument, the straw floating preventing part being made of an edible material which is dissolved in the drinking fluid after a predetermined time elapses, whereby the straw and the straw floating preventing part are inserted into the drink instrument which is to be opened at the center portion of the top surface thereof and upon the opening of the center portion thereof, the straw is drawn to the outside of the drink instrument by the operation of the buoyancy thereof.

The straw preferably comprises: the plurality of upright guides being adapted to be upright at the bottom end of the inner pipe and a predetermined position of the outer pipe; a first locking projection on a predetermined position of the outer pipe for preventing the deviation of the inner pipe; and a stopper adapted to be inserted into the top portion of the first locking projection for preventing the deviation of the outer pipe from the drink instrument, the stopper having a deviation preventing plate formed on the outer peripheral surface of the top end thereof for being locked to a center opening of the drink instrument, without any deviation and a second locking projection formed on the lower end thereof to which the first locking projection of the outer pipe is locked to prevent the deviation of the outer pipe.

Otherwise, the straw comprises: the plurality of upright guides being adapted to be upright at the bottom end of the inner pipe and a predetermined position of the outer pipe; a locking projection on a predetermined position of the outer pipe for preventing the deviation of the inner pipe; and a deviation preventing plate of a predetermined radius formed on the top portion of the locking projection to be locked to the center opening of the drink instrument, without any deviation, the deviation preventing plate integrally formed with the radial upright guides on the outer peripheral surface thereof.

Each of the upright guides formed on the outer peripheral surface of the straw has a plurality of horizontally formed guide plates radially within the radius of the drink instrument and is retracted vertically by the outer pipe inserted to the outside.

Preferably, the drink instrument, generally in a form of a beverage can or bottle has an opener at the top surface thereof and an opening containing a primary opening member which is cut by the manipulation of the opener for forming a hole thereon, comprises a center opening member formed on the center portion of the top surface of the can to be continued with the primary opening member and cut by a secondary manipulation of the opener and a reentrant portion provided to easily grasp the opener.

Each of the guide members of the upright guide is provided with a reentrant groove, such that it can be bent to be inserted when passing a bottle neck.

According to the present invention, a drink instrument for carrying drinking fluid comprises a container, generally a beverage can or bottle, defining an opening that is enclosed by a removable opening member; and a straw assembly disposed inside the container to be withdrawn through the opening when the opening member is removed. The straw assembly comprises an outer pipe longitudinally erected inside the container; an inner pipe slidably disposed inside the outer pipe, the inner pipe having a plurality of upright guides radially extending from a lower portion of the inner pipe to place the inner pipe substantially below the opening of the container, and a straw floating preventing part with a predetermined load slidably positioned in surrounding relation to the inner pipe to counter act the buoyancy of the inner pipe and to keep the inner pipe to be placed on the bottom of the container. The straw assembly further includes a cylindrically shaped stopper placed in surrounding relation to the outer pipe, wherein the stopper is larger than the opening of the container to prevent the outer pipe from completely withdrawn from the container.

According to one aspect of the present invention, the outer pipe has a plurality of upright guides extending therefrom, the upright guides radially extending from the outer pipe to place the outer pipe substantially below the opening of the container. When being used, the upright guides of the inner pipe retracts inside the outer pipe as the inner pipe is pulled from the outer pipe. According to another aspect of the present invention, the straw floating preventing part is made of an edible material which dissolves in the drinking fluid after a predetermined time has elapsed.

According to the present invention, a method of manufacturing a drink instrument for carrying drinking fluid comprises the steps of providing a container defining an opening that is enclosed by a removable opening member, disposing a straw assembly inside the container to be withdrawn through the opening when the opening member is removed; filling the container with the drinking fluid; and sealing the opening of the container. As described above, the straw assembly comprises an outer pipe longitudinally erected inside the container; an inner pipe slidably disposed inside the outer pipe, the inner pipe having a plurality of upright guides radially extending from a lower portion of the inner pipe to place the inner pipe substantially below the opening of the container; and a straw floating preventing part with a predetermined load slidably positioned in surrounding relation to the inner pipe to counter act the buoyancy of the inner pipe and to keep the inner pipe to be placed on the bottom of the container.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings.

FIGS. 3A and 3B are assembled sectional views of FIG. 1, wherein FIG. 3A shows the drink instrument upon a package process and FIG. 3B shows the drink instrument when a predetermined time elapses after packaging;

FIGS. 6A and 6B are sectional views illustrating a drink instrument with an internal straw according to second embodiment of the present invention, wherein FIG. 6A shows the drink instrument upon a package process and FIG. 6B shows the drink instrument during use;

FIGS. 7A and 7B are sectional views illustrating a drink instrument with an internal straw according to a third embodiment of the present invention, wherein FIG. 7A shows the drink instrument upon a package process and FIG. 7B shows the drink instrument during use;

FIGS. 8A and 8B are partial sectional views illustrating operation states of the drink instrument according to the embodiment of the present invention, wherein FIG. 8A shows the drink instrument upon a primary manipulation of an opener and FIG. 8B shows the drink instrument when the inner pipe of the straw is drawn after a second manipulation of the opener;

DETAILED DESCRIPTION OF PREFERRED EMBODIMENT

Reference will now be made in detail to preferred embodiments of the present invention, examples of which are illustrated in the accompanying drawings.

Figure 1:
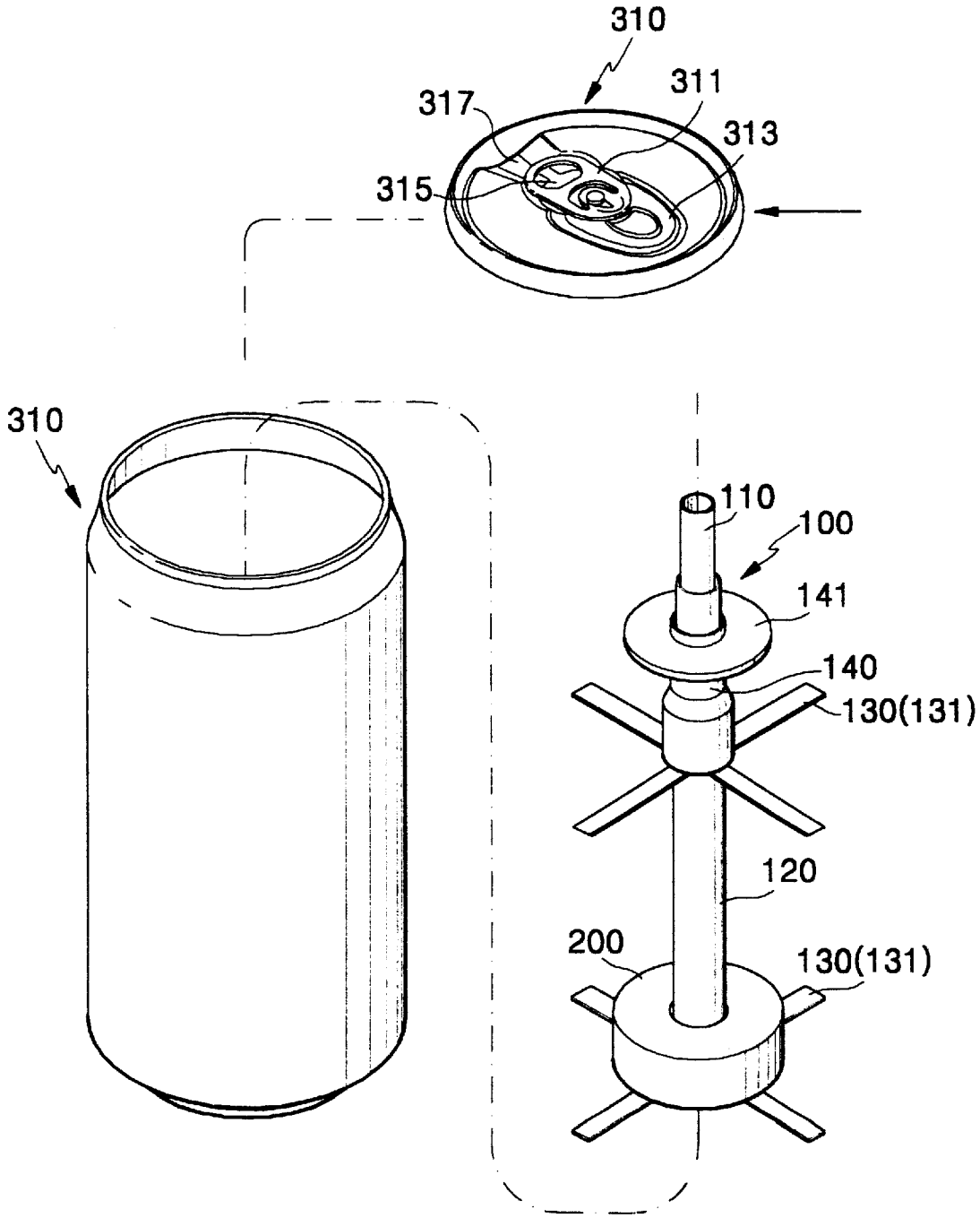
FIG. 1 is an exploded perspective view illustrating a drink instrument with an internal straw according to a first embodiment of the present invention.
Figure 2:
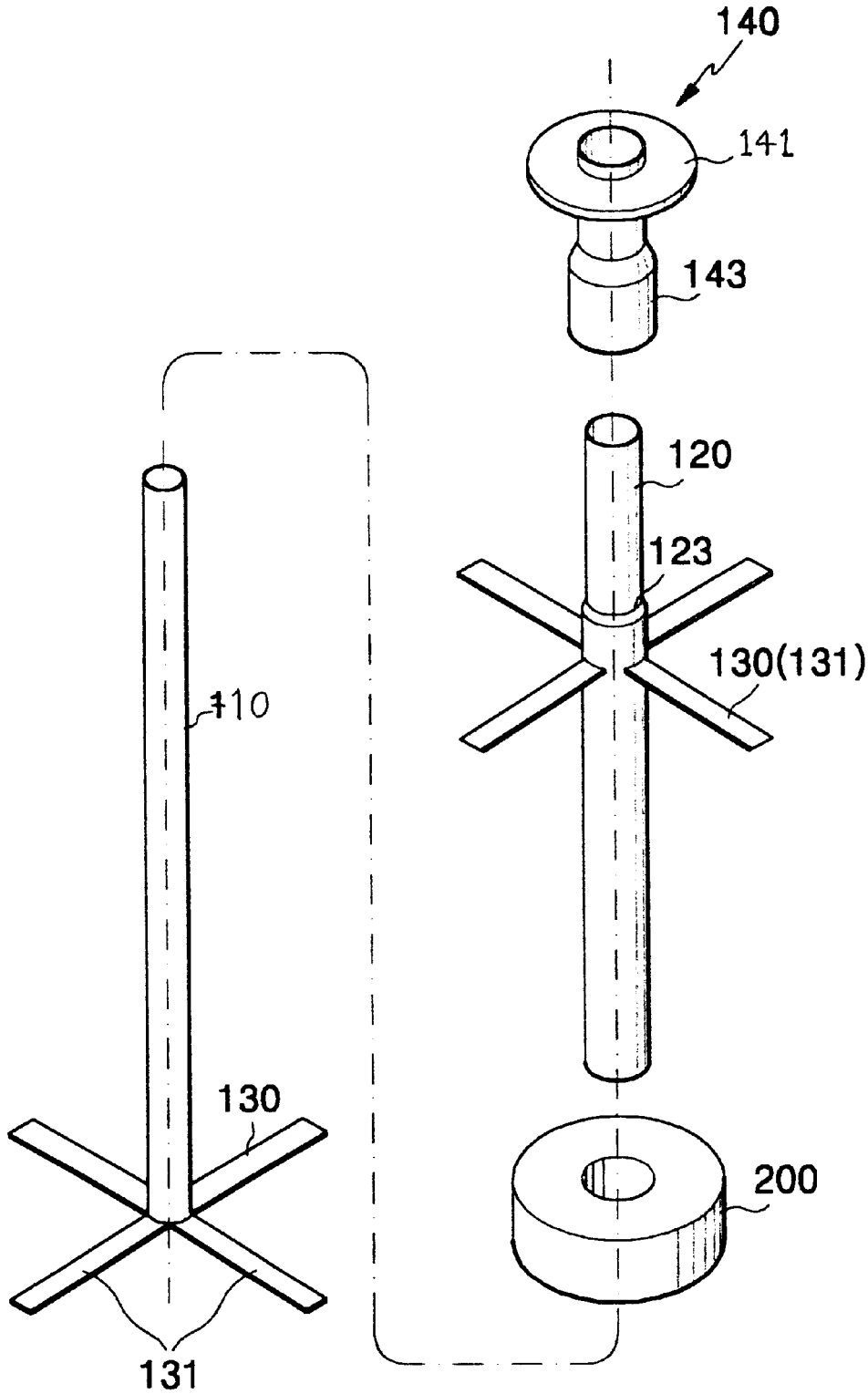
FIG. 2 is an exploded perspective view illustrating the internal straw of FIG. 1.
Figure 3A:
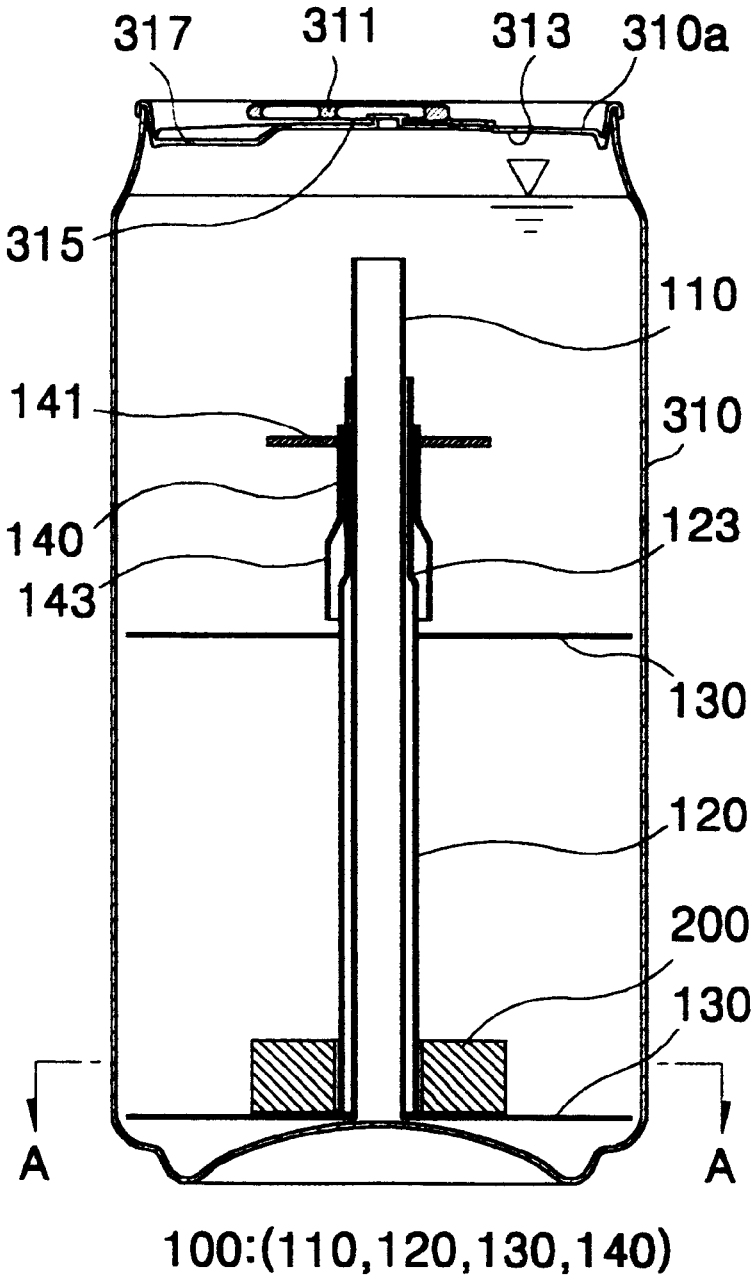
Figure 3B:
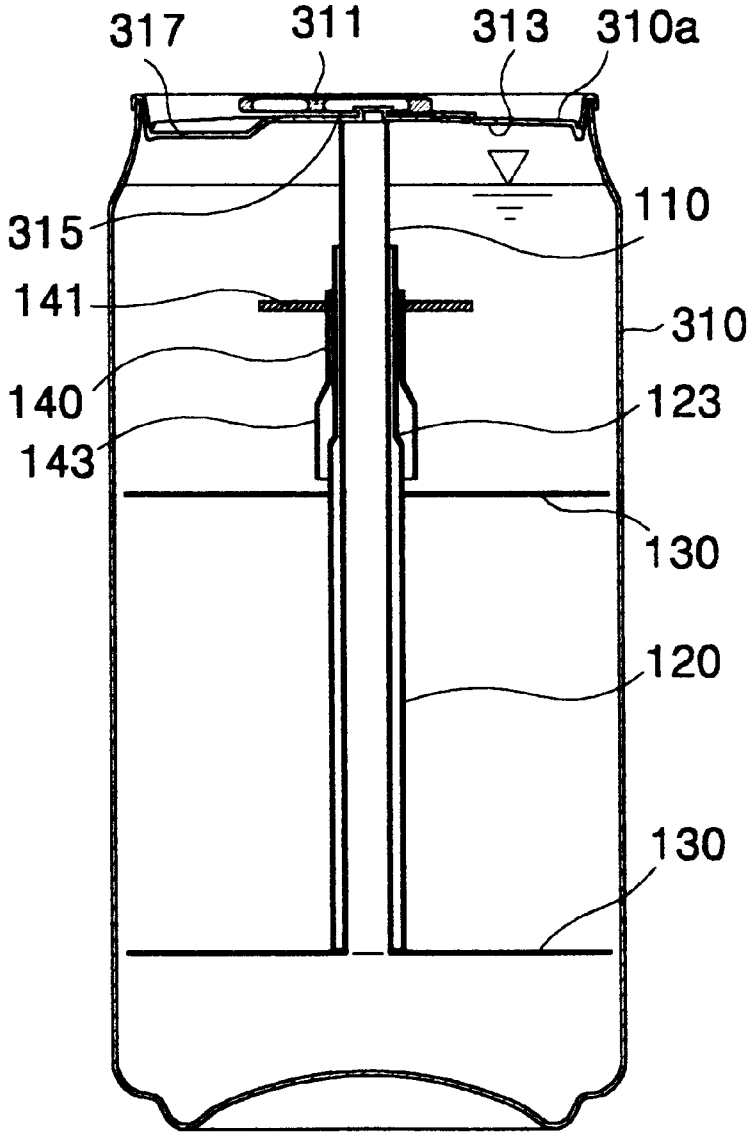
Figure 4:
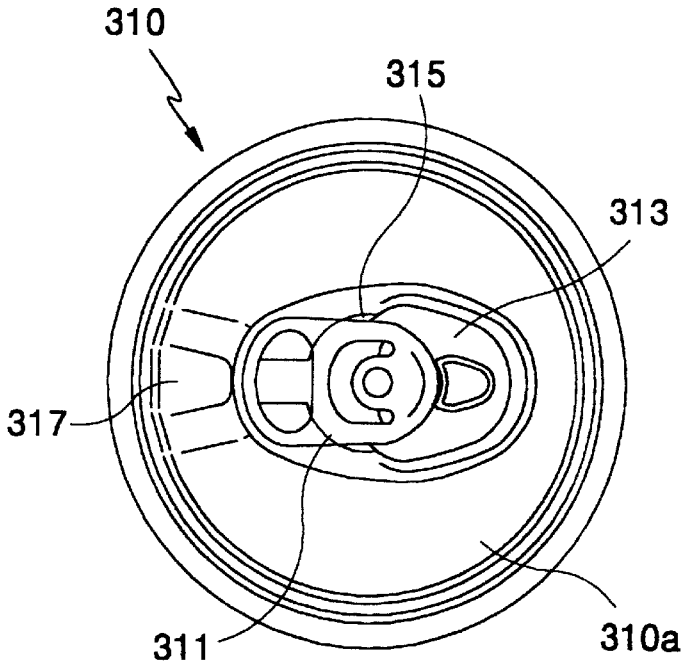
FIG. 4 is a plan view illustrating a can as the drink instrument of FIG. 1.
Figure 5:
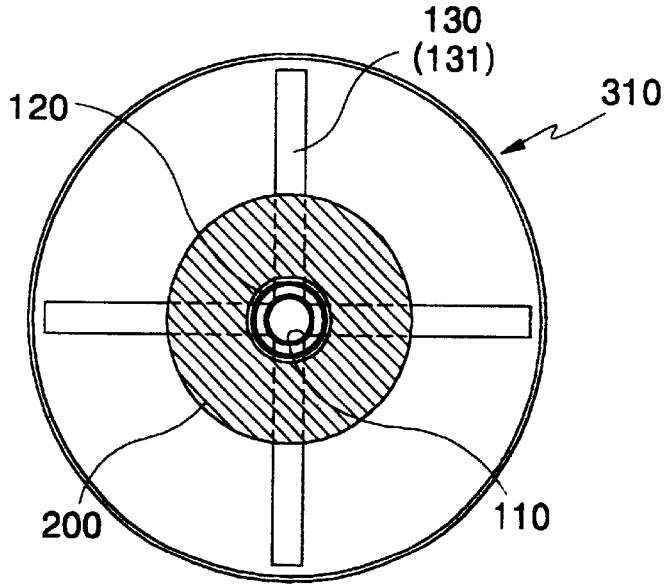
FIG. 5 is a sectional view taken along the line A—A of FIG. 3A.

Referring to the drawings, FIG. 1 is an exploded perspective view illustrating a drink instrument 310 with an internal straw assembly 100 (hereinafter referred to as the "straw") according to a first embodiment of the present invention. FIG. 2 is an exploded perspective view illustrating the internal straw of FIG. 1. FIGS. 3A and 3B are assembled sectional views of FIG. 1, wherein FIG. 3A shows the drink instrument 310 upon a package process and FIG. 3B shows the drink instrument 310 when a predetermined time elapses after packaging. FIG. 4 is a plan view illustrating a beverage container, such as an aluminum can, as the drink instrument 310 of FIG. 1 and FIG. 5 is a sectional view taken along the line A—A of FIG. 3A.

As shown in FIGS. 1 to 5, a drink instrument 310 in a form of a beverage can, with an internal straw according to a first embodiment of the present invention includes the straw 100 forming a plurality of upright guides 130 which are adapted to be upright at the center portion of the drink instrument 310, as an integral body with a predetermined outer peripheral surface thereof. The straw 100 is comprised of an outer pipe 120 and an inner pipe 110 extending along the length of the outer pipe 120, being adapted to draw a suction part, and having a predetermined buoyancy. The straw 100 also includes a straw floating preventing part 200 with a predetermined load being inserted into the lower portion of the straw 100. The floating preventing part 200 is adapted to serve as the bob of weight to be thereby submerged at the lower portion thereof on the bottom of the drink instrument 310 upon the insertion of the straw 100 into the interior of the drink instrument 310. The straw floating preventing part 200 is preferably made of an edible material which dissolves in the driting fluid contained in the drink instrument 310 after a predetermined time elapses. The straw 100 and the straw floating preventing part 200 are inserted into the drink instrument 310 which is to be opened at the center portion of the upper surface thereof. Upon the opening of the center portion of the drink instrument 310, the straw 100 is drawn to the outside of the drink instrument 310 by the buoyancy of the straw 100.

The straw 100, which is inserted into, for example, a beverage can 310, includes a plurality of upright guides 130. Each one of the upright guides 130 is extended radially from the bottom end of the inner pipe 110. In addition, a plurality of upright guides 130 are also radially extending from the near upper portion of the outer pipe 120. The straw 100 also includes a cylindrically shaped stopper 140 adapted to be inserted into the top portion of a locking projection 123 of the outer pipe 120. The outer pipe 120 forms the locking projection 123 preferably above the upright guides 130. The locking projection 123 releasably engages the 10 stopper 140 which is placed thereon.

According to the first embodiment, there are shown four uprights guides 130 extended from the inner pipe 110 and four upright guides 130 extending from the outer pipe 120. Alternative, the present invention may be exercised with two or more upright guides 130 extending from either inner pipe 100 or outer pipe 120.

The stopper 140, which is inserted onto the top portion of the locking projection 123 of the outer pipe 120, serves to prevent the outer pipe 120 from the beverage can 310. In particular, the stopper 140 includes a deviation preventing plate 141 formed on the outer peripheral surface of the top end thereof for being locked to a center opening 315 of the beverage can 310, without any deviation. The stopper 140 also includes a locking projection 143 formed on the lower end thereof to which the locking projection 123 of the outer pipe 120 is locked to prevent the deviating movement of the outer pipe 120. The deviation preventing plate 141 may form a plurality of slit grooves radially thereon for the purpose of being retracted upon a forcible drawing.

Figure 6A:
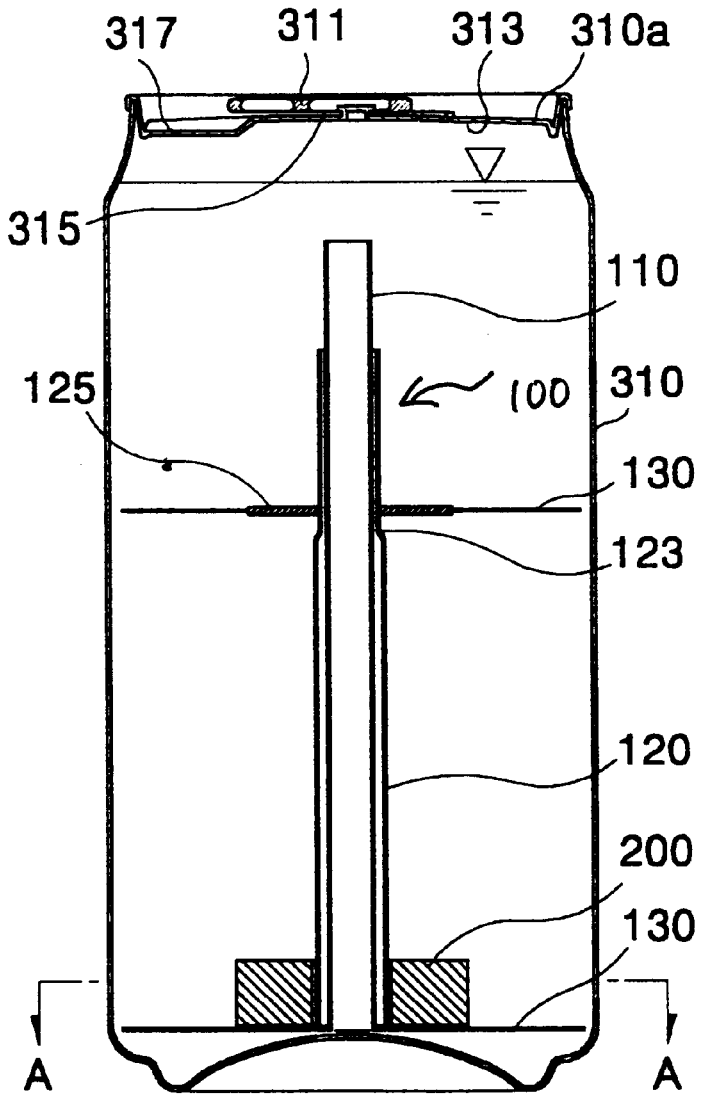
Figure 6B:
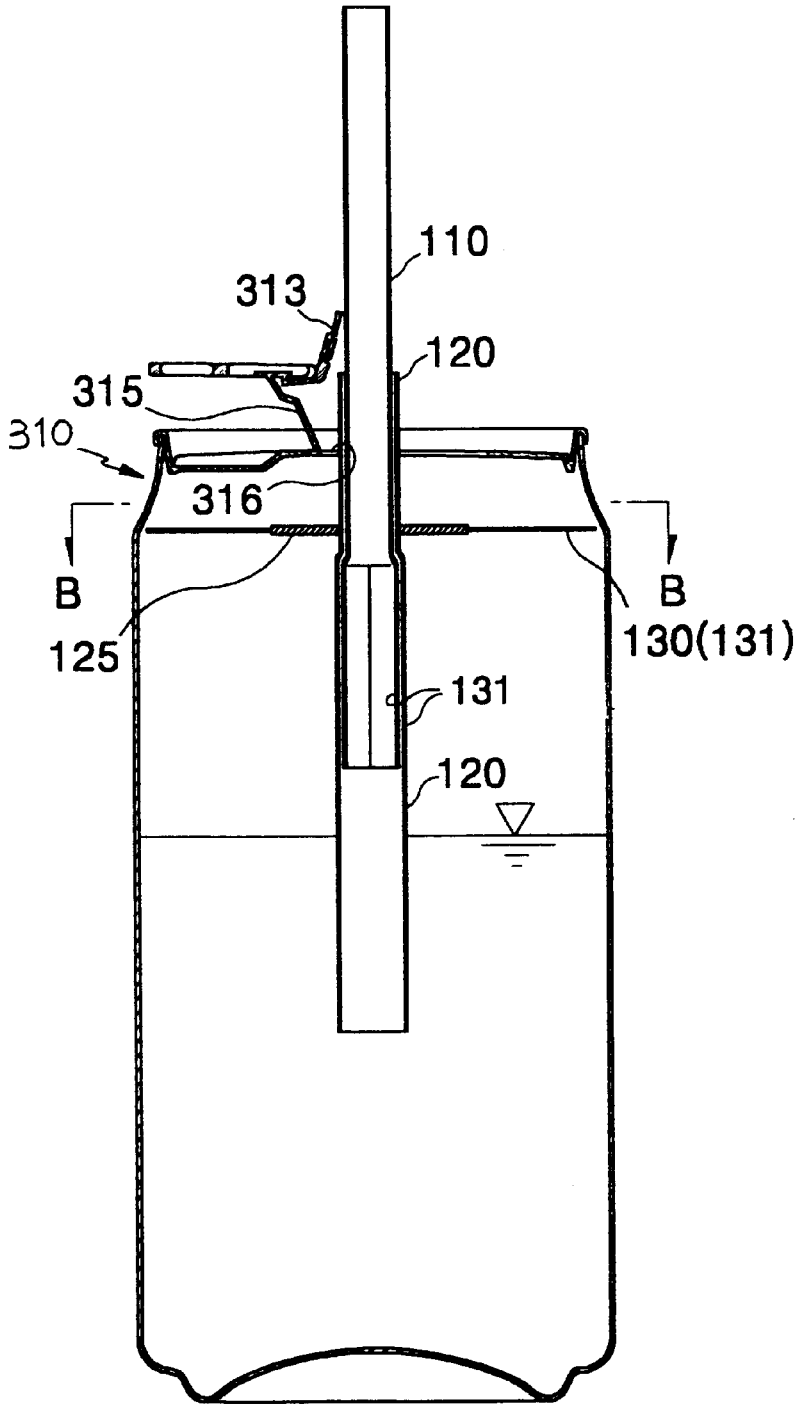
Figure 6C:
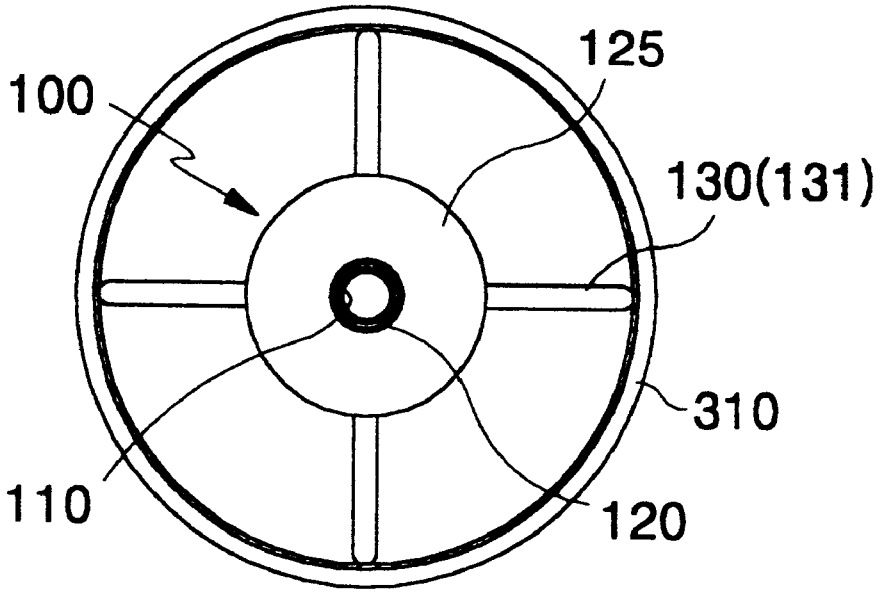
FIG. 6C is a sectional view taken along the line B—B of FIG. 6B.

FIGS. 6A and 6B are sectional views illustrating a drink instrument with an internal straw according to a second embodiment of the present invention. FIG. 6A shows the drink instrument 310 with the straw 100 packaged therein. FIG. 6B shows the drink instrument 310 with the straw protruding therefrom. FIG. 6C is a sectional view taken along the line B—B of FIG. 6B.

As illustrated, the straw 100, which is inserted into a beverage container, such as an aluminum can 310, includes a plurality of upright guides 130 being upright at the bottom end of the inner pipe 110 and a predetermined position of the outer pipe 120. The straw 100 also includes a locking projection 123 disposed near the upper portion of the outer pipe 120 for preventing the inner pipe 110 from being separated from the outer pipe 120 as shown in FIG. 6B. The straw 100 according to the second embodiment also includes a deviation preventing plate 125 of a predetermined radius formed on the top portion of the locking projection 123 to be locked substantially near the center opening of the beverage can 310. The deviation preventing plate 125 is integrally formed with the top upright guides 130 which radially extend from the outer peripheral surface of the deviation preventing plate 125. It is preferred that the deviation preventing plate 125 is thickener than the top upright guide 130 on the outer peripheral surface thereof. The deviation preventing plate 125 is sufficiently larger than a center opening member 315 formed on the beverage can 310 to keep the lower portion of the outer pipe 120 within the beverage can 310.

Referring to FIGS. 6B and 6C, each one of the upright guides 130, which is formed on the outer peripheral surface of the outer pipe 120, comprises a plurality of horizontally formed guide members 131 radially extending within the radius of the beverage can 310. Each of the upright guides 130 is formed on the upper and lower portions of the straw 100, respectively, for the purpose of biasing the straw 100 in an upright position near the center of the beverage can 310.

According to the preferred embodiments, the straw floating preventing part 200 is made by solidifying an edible ingredient contained in the drinking fluid, such as sugar or sugar-free substance, so that it has a predetermined load. As a result, the drinking fluid to be placed in the beverage container should be processed to include ingredient forming the straw floating preventing part 200 is dissolved.

Referring to FIG. 6A, the drink instrument, such as a beverage can 310, has an opener 311 at the top surface 310*a* thereof and an opening containing a primary opening member 313 which is cut by the manipulation of the opener 311 for forming a hole thereon. The top surface 310*a* of the drink instrument includes a center opening member 315 formed substantially at the center portion of the top surface 310*a* of the beverage can 310. The center opening member 315 extends from the primary opening member 313 to define a large hole when both members are separated from the top surface 310*a*. The center opening member 315 is precut similar to that of the primary opening member 313 so that the center opening is created by a secondary manipulation of the opener 311 in an upward pulling fashion. A reentrant portion 317 is formed on the top surface 310*a* to easily grasp the opener 311.

The center opening member 315 formed near the center portion of the top surface 310*a* of the beverage can 310 has the same cutting line structure used in the conventional practice and known to one of ordinary skill in the art. The center opening member 315 is cut off by pulling one side thereof during the secondary manipulation of the opener 311. For purposes of recycling, the cutting line of the center opening member 315 is formed in such a manner that the center opening member 315 is not completely separated from the top surface 310*a* of the beverage can 310.

Figure 7A:
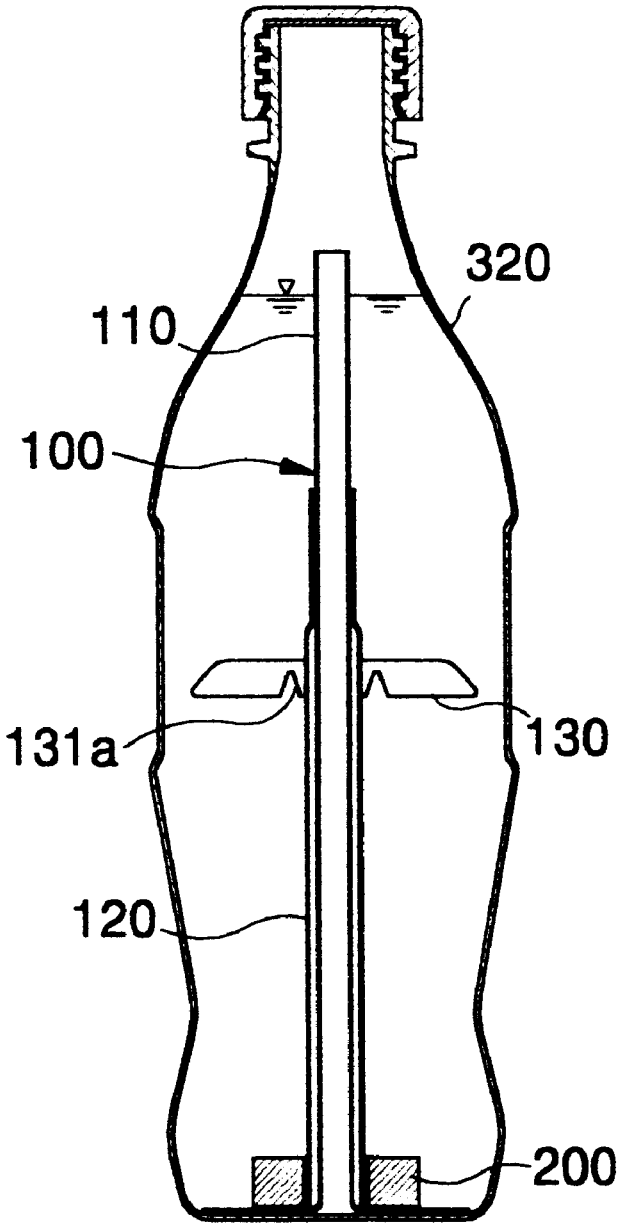
Figure 7B:
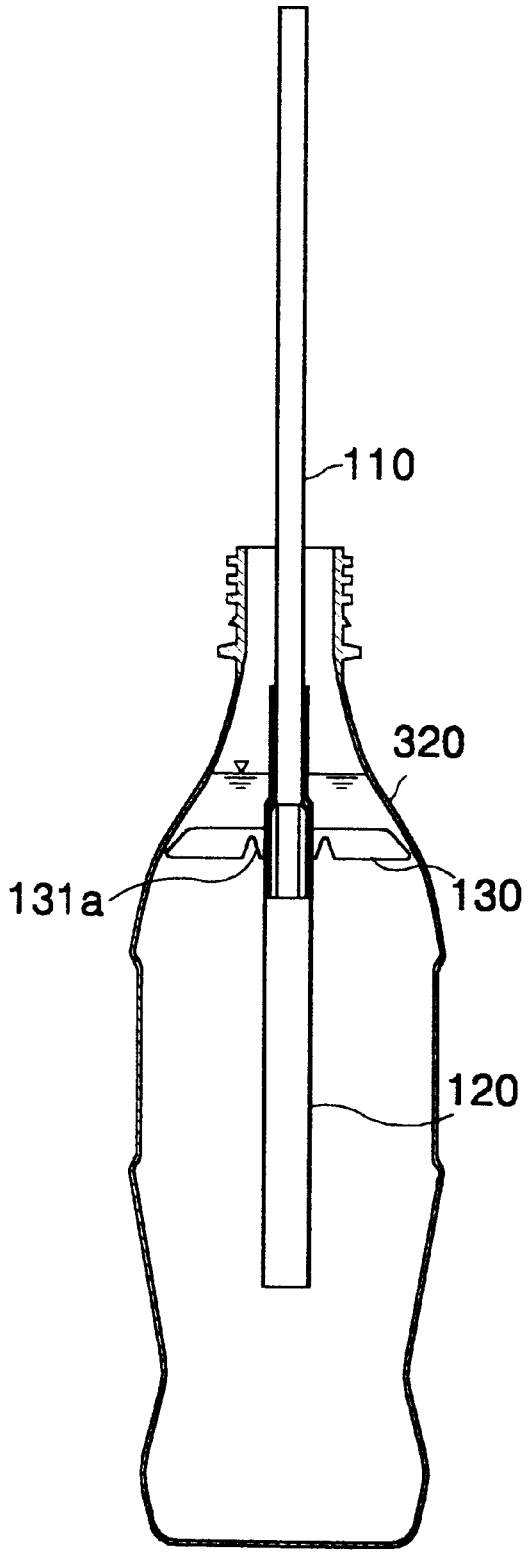

FIGS. 7A and 7B illustrate the use and structure of the present invention in a drink instrument in a form of a bottle. As shown in FIGS. 7A and 7B, in case where the drink instrument is a bottle 320, the upright guide 130 may be formed only on the top portion of the outer pipe 120 and the guide members 131*a* of the upright guide 130 each form a reentrant groove which is bent while the straw 100 is being inserted through a bottle neck during a manufacturing process. The upright guides 130, which are integrally formed with the outer pipe 120 of the straw 100, are made of a resin material floatable in drinking fluid or other materials known to one of ordinary skill in the art. Such material should not be harmful to the human body.

According to the embodiment shown in FIGS. 7A and 7B, the structure of the inner pipe 110 and the outer pipe 120 is similar to that of the first embodiment, and therefore, their descriptions will not be repeated here. The straw 100 also includes a straw floating preventing part 200 is made by solidifying an edible ingredient contained in the drinking fluid, such as sugar or sugar-free substance, so that it has a predetermined load to prevent the straw 100 from being projecting upward during a bottling process.

Now, an explanation of the operation of the drink instrument with the internal straw according to the present invention will be discussed.

In case where the straw 100 has been inserted into the drink instrument 310 to be automatically drawn therefrom upon the opening of the drink instrument, such a requirement that the package process is added in a simple manner, without any alteration of the existing automatic production line should be primarily satisfied.

The package process where the drinking fluid is filled in the beverage can 310 comprises shaping a body of the beverage can, cleaning and pasteurizing the beverage can, filling the beverage can with the drinking fluid, and compressively bonding the top surface of the beverage can with the opener to the top end of the beverage can to seal the top surface and the can body.

Particularly, the package process which has a close relation with the principles of the present invention is the compression-bonding process of the top surface of the beverage can to the can body. In view of the automated factory production line, after filling the can with drinking fluid, the top surface is moved horizontally from the one side of the top end of the can to cover the top end of the can and it is then compressively bonded to the top end of the can.

In other words, the top surface of the can does not descend vertically to cover the top end of the can, but moves horizontally from the one side of the top end of the can at the height almost approaching the top end thereof. Therefore, so as to prevent the approaching path of the top surface from being interrupted, the position of the straw to be inserted into the can should not protrude from the top end of the can. As described above, a straw floating preventing part 200 made of a solid edible ingredient contained in the drinking fluidis used to prevent the straw 100 from being projecting upward during a manufacturing process.

Figure 8A:
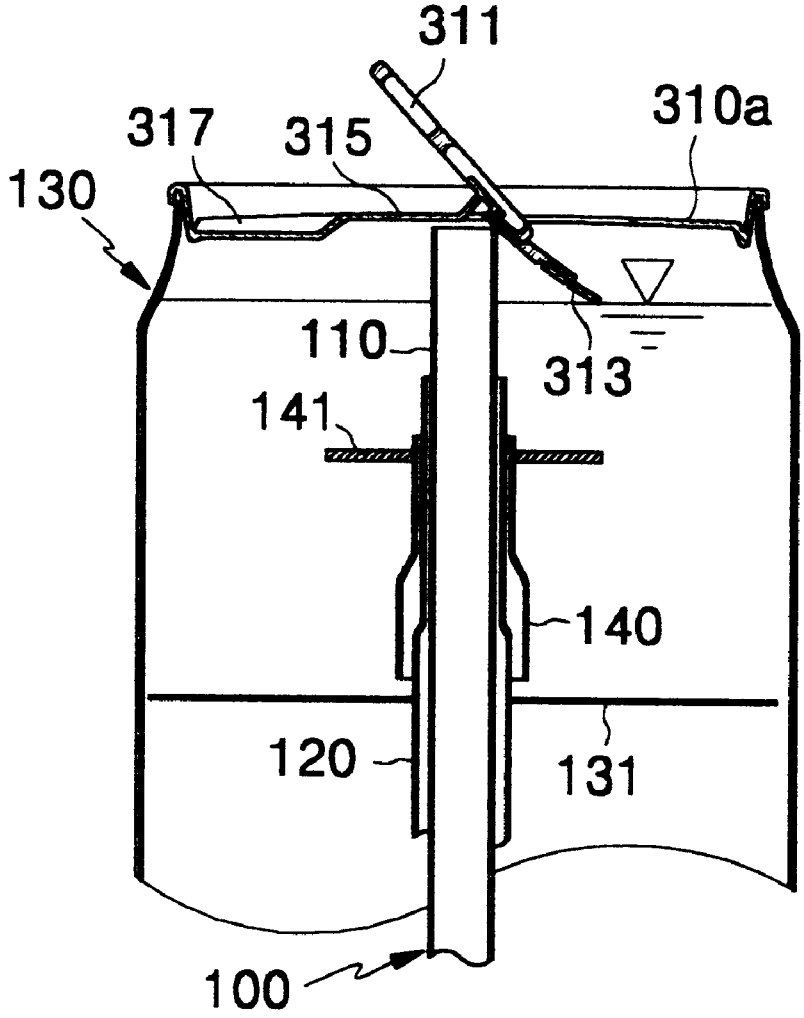
Figure 8B:
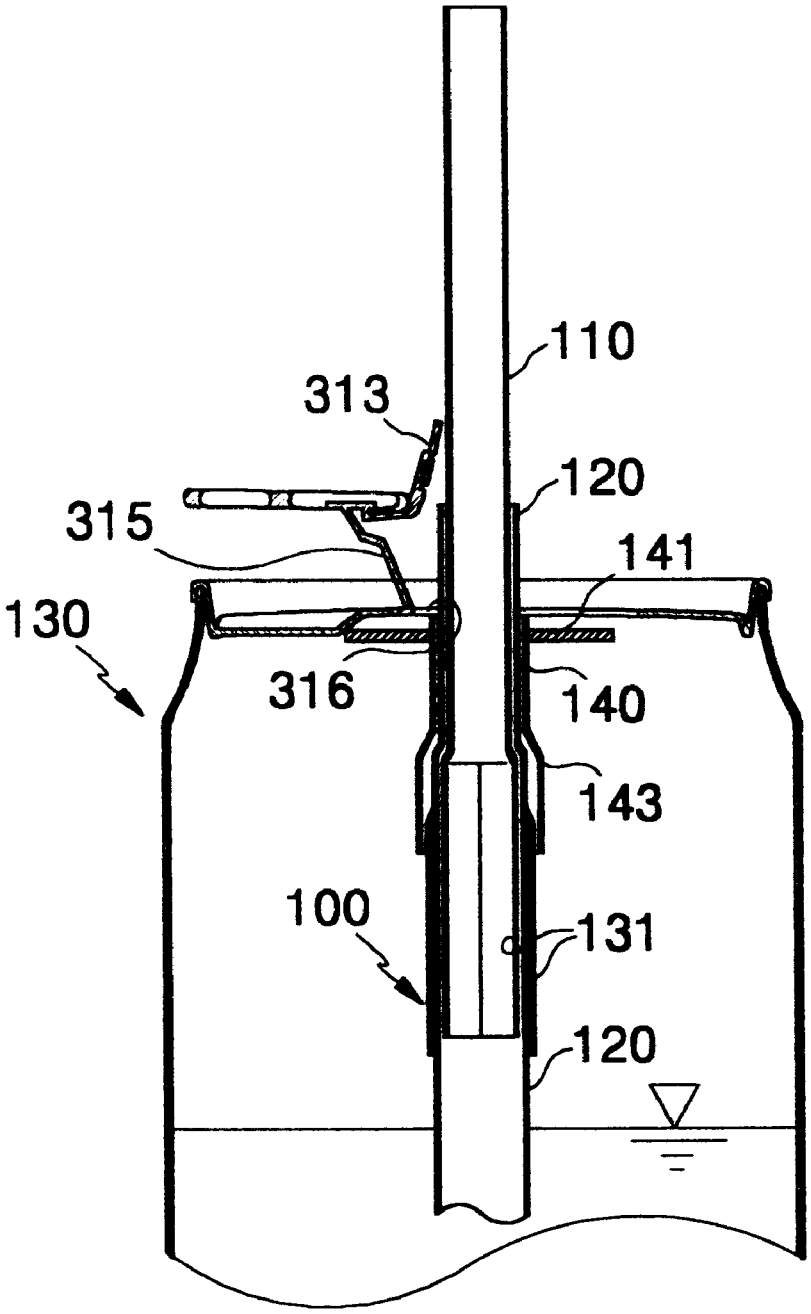
Figure 9:
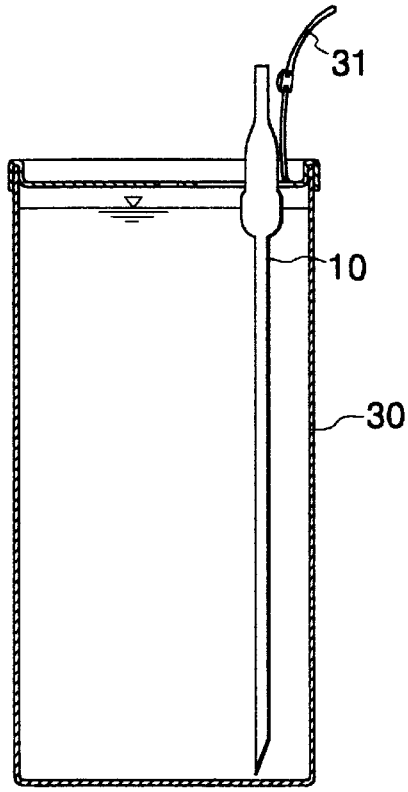
FIG. 9 is a sectional view illustrating a conventional drink instrument with an internal straw.
Figure 10:
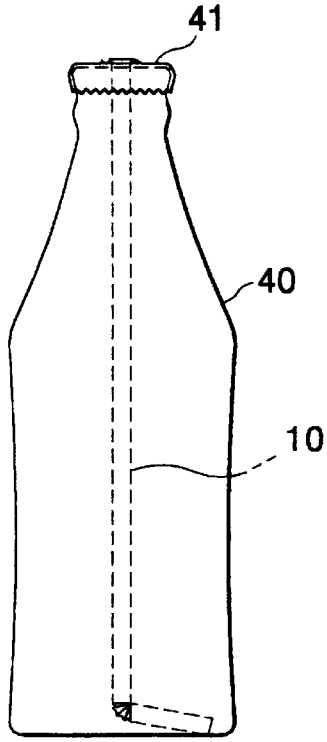
FIG. 10 is a sectional view illustrating another type of the conventional drink instrument with the internal straw.

FIGS. 8A and 8B are partial sectional views illustrating operation states of the drink instrument according to the present invention. In particular, FIG. 8A shows the drink instrument upon a primary manipulation of an opener 311. FIG. 8B shows the drink instrument when the inner pipe 110 of the straw 100 is drawn after a secondary manipulation of the opener 311.

The straw 100 according to the present invention, as shown in FIGS. 1 to 8B, forms the upright guide 130 having a plurality of horizontally formed guide members 131 radially extending from the outer pipe 120 and disposed within the drink instrument at the upper and lower portions thereof. Even if various insertion methods of the straw 100 are applied, the straw 100 is always erected upright near the center portion of the drink instrument.

Moreover, as shown in FIG. 3A, the straw floating preventing part 200, for example, sugar, having a predetermined weight is disposed on the lower portion of the straw 100, such that the straw 100 is preferably in contact with the bottom of the drink instrument (which is shown in FIG. 3A) upon the package process of the drink instrument. If a predetermined time elapses, the straw floating preventing part 200 is dissolved in the drinking fluid, such that the straw 100 floats by the operation of its buoyancy and is in contact with the top surface of the drink instrument (which is shown in FIG. 3B). At this time, if the center opening member of the top surface of the drink instrument is removed, the straw 100 being in the buoyant state is automatically drawn from the drink instrument.

If the amount of the drinking fluid is reduced within the drink instrument, the inner pipe 110 of the straw 100 may be extended away from the outer pipe 120 to increase the overall length thereof, and at the same time, the upright guides 130 projected from the lower portion of the inner pipe 110 are retracted by the outer pipe 120 to be drawn to the interior of the outer pipe 120, with a consequence that the upright guide 130 is locked to the locking projection 123 on the outer pipe 120 to prevent the inner pipe 110 from separated from the outer pipe 120.

The deviation preventing plate 141 of the stopper 140 and the deviation preventing plate 125 integrally formed with the outer pipe 120 serve to prevent the straw 100 from being completely ejected from the center opening 316 of the can during drinking.

To separate the straw 100 from the can 310 after drinking, the straw 100 is pushed toward the primary opening side which defines a relatively large hole where the primary opening member 313 has been lifted from the top surface. The straw 100 is then separated from the can, without any difficulty.

The beverage can 310 of the present invention forms the center opening member 315 on the top surface thereof, as shown in FIG. 1 and as best seen in FIGS. 8A and 8B. If the primary manipulation of the opener 311 is carried out to pull the opener, the primary opening member 313 is cut off to be compressively inserted into the interior of the can with the one side thereof connected to the top surface of the can. With only the primary opening, the drinking fluid is poured in a cup like a conventional practice.

As one of principal features of the preferred embodiment of the present invention, the center opening member 315, which is connected as an integral body with the primary opening member 313, is positioned on the center portion of the top surface 310*a* of the can. If the secondary manipulation of the opener 311 is carried out to pull the opener, the center opening member 315 is cut off to open the center portion of the top surface of the can. In other words, upon the primary pulling manipulation of the opener 311, the can 310 of the present invention makes the primary opening member 315 open, thereby pouring the drinking fluid in the cup.

If the straw 100 is to be used, the secondary pulling of the opener 311 is carried out to make the center opening member 315 on the top surface thereof open, thereby drawing the straw 100 from the interior of the can by the operation of buoyancy of the straw 100. At this time, a part of the center opening member 315 is connected to the top surface 310*a* to prevent the center opening member 315 from being completely separated therefrom, such that the recycling of the can can be efficiently achieved. The reentrant portion 317 into which a finger of a user is inserted is formed on the lower portion of the opener 311 of the can to easily grasp the opener 311.

In case of the straw 100 which is inserted into a bottle, on the other hand, each of the guide members 131 is provided with a groove 131*a* thereon, such that it can be bent to be inserted when passing the bottle neck having a relatively small radius.

The main features of the present invention are as follows: a) even if various insertion methods of the straw 100 are applied, the straw 100 should be automatically erected on the center portion of the drink instrument; b) the center opening member 315 should be formed on the center of the top surface 310*a* of the drink instrument to draw the straw 100; c) in order to prevent the existing packaging process line from being more complicated, upon the packaging process the straw floating preventing part 200 is disposed to prevent the straw 100 from being protruded to the outside of the drink instrument; and d) the straw 100 can exert its buoyancy after a predetermined time elapses.

As discussed above, a drink instrument with an internal straw of the present invention has the following features: the straw is automatically erected on the center portion of the drink instrument; the center opening member is formed on the center of the top surface of the drink instrument to draw the straw; to avoid expensive re-tooling of the assembly line the straw according to the present invention remains at the bottom of the container during packaging process; and the straw exerts its buoyancy after a predetermined time elapses, such that the packaging process where the insertion of the straw into the drink instrument is carried out easily, without any alteration of the existing automatic production line. The drink instrument with the internal straw according to the present invention eliminates the necessity for having a separate straw when drinking.

It will be apparent to those skilled in the art that various modifications and variations can be made in a drink instrument with an internal straw according to the present invention without departing from the spirit or scope of the invention. Thus, it is intended that the present invention cover the modifications and variations of this invention provided they come within the scope of the appended claims and their equivalents.

what is claimed is:

1. A drink instrument with an internal straw, comprising:

the internal straw forming a plurality of upright guides which are adapted to be upright at the center portion of the drink instrument, as an integral body with a predetermined outer peripheral surface thereof, the internal straw comprising an outer pipe and an inner pipe for the purpose of extending the length thereof, being adapted to draw a suction part, and having a predetermined buoyancy; and a straw floating preventing part with a predetermined load being inserted into the lower portion of the internal straw and being adapted to serve as the bob of weight to be thereby submerged at the lower portion thereof on the bottom of the drink instrument upon the insertion of the internal straw into the interior of the drink instrument, the straw floating preventing part being made of an edible material which is dissolved in the drinking fluid after a predetermined time elapses, wherein the internal straw and the straw floating preventing part are inserted into the drink instrument which is to be opened at the center portion of the top surface thereof and upon the opening of the center portion thereof, the internal straw is drawn to the outside of the drink instrument by the operation of the buoyancy thereof.

2. The drink instrument of claim 1, wherein the internal straw comprises: the plurality of upright guides being upright at the bottom end of the inner pipe and a predetermined position of the outer pipe; a first locking projection on a predetermined position of the outer pipe for preventing the deviation of the inner pipe; and a stopper adapted to be inserted into the top portion of the first locking projection for preventing the deviation of the outer pipe from the drink instrument, the stopper having a deviation preventing plate formed on the outer peripheral surface of the top end thereof for being locked to a center opening of the drink instrument, without any deviation and a second locking projection formed on the lower end thereof to which the first locking projection of the outer pipe is locked to prevent the deviation of the outer pipe.

3. The drink instrument of claim 1, wherein the internal straw comprises: the plurality of upright guides being upright at the bottom end of the inner pipe and a predetermined position of the outer pipe; a locking projection on a predetermined position of the outer pipe for preventing the deviation of the inner pipe; and a deviation preventing plate of a predetermined radius formed on the top portion of the locking projection to be locked to the center opening of the drink instrument, without any deviation, the deviation preventing plate integrally formed with the radial upright guides on the outer peripheral surface thereof.

4. The drink instrument of claim 1, wherein each of the upright guides formed on the outer peripheral surface of the internal straw has a plurality of horizontally formed guide members radially extending within the radius of the drink instrument and is retracted vertically by the outer pipe inserted to the outside.

5. The drink instrument of claim 2, wherein each of the upright guides formed on the outer peripheral surface of the internal straw has a plurality of horizontally formed guide members radially extending within the radius of the drink instrument and is retracted vertically by the outer pipe inserted to the outside.

6. The drink instrument of claim 3, wherein each of the upright guides formed on the outer peripheral surface of the internal straw has a plurality of horizontally formed guide members radially extending within the radius of the drink instrument and is retracted vertically by the outer pipe inserted to the outside.

7. The drink instrument of claim 1, wherein the drink instrument, us ed as a typical drinking can which includes an opener at the top surface thereof and an opening containing a primary opening member which is cut by the manipulation of the opener for forming a hole thereon, comprises a center opening member formed on the center portion of the top surface of the can to be continued with the pradu opening member and cut by a secondary manipulation of the opener and a reentrant portion formed to easily grasp the opener.

8. The drink instrument of claim 1, wherein each of the guide members of the upright guide is provided with a reentrant groove, such that it can be bent to be inserted when passing a bottle neck.

9. A drink instrument for carrying drinking fluid, comprising:

a container defining an opening that is enclosed by a removable opening member; and a straw assembly disposed inside the container to be withdrawn through the opening when the opening member is removed, the straw assembly comprising;

an outer pipe longitudinally erected inside the container;

an inner pipe slidably disposed inside the outer pipe, the inner pipe having a plurality of upright guides radially extending from a lower portion of the inner pipe to place the inner pipe substantially below the opening of the container, and a straw floating preventing part with a predetermined load slidably positioned in surrounding relation to the inner pipe to counter act the buoyancy of the inner pipe and to keep the inner pipe to be placed on the bottom of the container.

10. The drink instrument of claim 9, wherein the outer pipe has a plurality of upright guides extending therefrom, the upright guides radially extending from the outer pipe to place the outer pipe substantially below the opening of the container.

11. The drink instrument of claim 9, wherein the straw floating preventing part is made of an edible material which dissolves in the drinking fluid after a predetermined time has elapsed.

12. The drink instrument of claim 9, the straw assembly further including a cylindrically shaped stopper placed in surrounding relation to the outer pipe, wherein the stopper is larger than the opening of the container to prevent the outer pipe from completely withdrawn from the container.

13. The drink instrument of claim 9, wherein the upright guides of the inner pipe retracts inside the outer pipe as the inner pipe is pulled from the outer pipe.

14. The drink instrument of claim 10, wherein the straw floating preventing part is made of an edible material which dissolves in the drinking fluid after a predetermined time has elapsed.

15. The drink instrument of claim 14, the straw assembly further including a cylindrically shaped stopper placed in surrounding relation to the outer pipe, wherein the stopper is larger than the opening of the container to prevent the outer pipe from completely withdrawn from the container.

16. The drink instrument of claim 15, wherein the upright guides of the inner pipe retracts inside the outer pipe as the inner pipe is pulled from the outer pipe.

17. The drink instrument of claim 9, wherein the container is a beverage can.

18. The drink instrument of claim 9, wherein the container is a beverage bottle.

* * * * *